US009524855B2

(12) United States Patent
Schoen et al.

(10) Patent No.: US 9,524,855 B2
(45) Date of Patent: Dec. 20, 2016

(54) CASCADED-SIGNAL-INTENSIFIER-BASED ION IMAGING DETECTOR FOR MASS SPECTROMETER

(71) Applicant: Thermo Finnigan LLC, San Jose, CA (US)

(72) Inventors: Alan E. Schoen, San Jose, CA (US); Johnathan Wayne Smith, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/567,744

(22) Filed: Dec. 11, 2014

(65) Prior Publication Data

US 2016/0172173 A1 Jun. 16, 2016

(51) Int. Cl.

| | |
|---|---|
| ***H01J 49/02*** | (2006.01) |
| *H01J 49/42* | (2006.01) |
| *H01J 49/00* | (2006.01) |
| *H01J 43/04* | (2006.01) |

(52) U.S. Cl.

CPC ..... *H01J 49/025* (2013.01); *H01J 43/045* (2013.01); *H01J 49/0031* (2013.01); *H01J 49/4215* (2013.01)

(58) Field of Classification Search

CPC ..... H01J 43/22; H01J 31/508; H01J 49/025; H01J 49/027; H01J 49/4215; H01J 43/045; H01J 49/0031; H01J 43/246; H01J 2237/24435

See application file for complete search history.

(56) References Cited

U.S. PATENT DOCUMENTS

| | | | | |
|---|---|---|---|---|
| 3,875,440 | A | 4/1975 | McGee | |
| 3,914,634 | A * | 10/1975 | Overall | H01J 43/22 313/105 CM |
| 4,482,836 | A * | 11/1984 | Washington | H01J 43/22 313/104 |
| 4,721,880 | A | 1/1988 | Mansell et al. | |
| 4,737,623 | A * | 4/1988 | Uhl | H01J 43/18 250/207 |
| 5,532,551 | A * | 7/1996 | Kyushima | H01J 9/12 250/214 VT |
| 5,801,511 | A | 9/1998 | Kyushima et al. | |
| 6,483,231 | B1 | 11/2002 | Iosue | |
| 6,617,768 | B1 * | 9/2003 | Hansen | H01J 49/025 313/103 CM |

(Continued)

*Primary Examiner* — Wyatt Stoffa

(74) *Attorney, Agent, or Firm* — Thomas F. Cooney

(57) ABSTRACT

A detector system for a mass spectrometer comprises: a metal channel dynode (MCD) comprising at least one perforated metal plate configured to receive the exiting ions and eject electrons in response; a plurality of electron-to-photon converters arranged in a parallel stacked configuration, each such converter comprising a substrate plate having a phosphor coating on a first face; and an electrode film disposed on the phosphor coating; at least one photocathode, each of the at least one photocathode disposed between a respective pair of the plurality of electron-to-photon converters; an optical detector optically coupled a last one of the electron-to-photon converters; and at least one direct current power supply configured to apply, in operation, a respective bias electrical potential to the MCD and each of the electrode films and photocathodes.

16 Claims, 11 Drawing Sheets

(56) References Cited

U.S. PATENT DOCUMENTS 6,958,474 B2 * 10/2005 Laprade ..... H01J 43/246 250/287
7,498,557 B2 3/2009 Pinkas et al.
7,564,043 B2 * 7/2009 Hayashi ..... H01J 49/025 250/287
7,741,758 B2 * 6/2010 Hanai ..... H01J 43/22 313/103 CM
8,389,929 B2 * 3/2013 Schoen ..... H01J 49/26 250/281
2005/0104527 A1 * 5/2005 Niigaki ..... H01J 1/32 315/168
2007/0263223 A1 * 11/2007 Hirai ..... H01J 37/244 356/450
2008/0290267 A1 * 11/2008 Hayashi ..... H01J 43/246 250/282
2010/0243887 A1 * 9/2010 Suyama ..... H01J 49/40 250/287
2011/0095174 A1 * 4/2011 Suyama ..... H01J 43/22 250/281
2011/0095178 A1 * 4/2011 Giannakopulos ..... H01J 49/025 250/282
2011/0215235 A1 * 9/2011 Schoen ..... H01J 49/26 250/282
2013/0146778 A1 * 6/2013 Nuetzel ..... H01J 1/32 250/370.14
2013/0175443 A1 * 7/2013 Schoen ..... H01J 49/26 250/288
2013/0268212 A1 * 10/2013 Makarov ..... H01J 49/025 702/32
2014/0151549 A1 * 6/2014 Steiner ..... H01J 43/30 250/288
2014/0246579 A1 * 9/2014 Hoyes ..... H01J 49/025 250/282
2015/0034819 A1 * 2/2015 Hoyes ..... H01J 49/025 250/282
2015/0162174 A1 * 6/2015 Badiei ..... H01J 49/0009 250/288

* cited by examiner

CASCADED-SIGNAL-INTENSIFIER-BASED ION IMAGING DETECTOR FOR MASS SPECTROMETER

CROSS REFERENCE TO RELATED APPLICATION

This application is related to a co-pending and commonly-assigned United States patent application titled "Recording Spatial and Temporal Properties of Ions Emitted from a Quadropole Mass Filter" (U.S. application Ser. No. 14/561,166), filed on Dec. 4, 2014 and having the named inventors of this application, the disclosure of which is incorporated herein by reference in its entirety.

FIELD OF THE INVENTION

The present invention relates to the field of mass spectrometry. More particularly, the present invention relates to a mass spectrometer detector system for detecting time-dependent two-dimensional distributions of ions that exit a mass analyzer of a mass spectrometer system.

BACKGROUND OF THE INVENTION

Typically, a multipole mass filter (e.g., a quadrupole mass filter) may be used for mass analysis of ions provided within a continuous ion beam. A quadrupole field is produced within the quadrupole apparatus by dynamically applying electrical potentials on configured parallel rods arranged with four-fold symmetry about a long axis, which comprises an axis of symmetry that is conventionally referred to as the z-axis. By convention, the four rods are described as a pair of "x-rods" and a pair of "y-rods". At any instant of time, the two x-rods have the same potential as each other, as do the two y-rods. The potential on the y-rods is inverted with respect to the x-rods. The "x-direction" or "x-dimension" is taken along a line connecting the centers of the x-rods. The "y-direction" or "y-dimension" is taken along a line connecting the centers of the y-rods.

Relative to the constant potential along the z-axis, the potential on each set of rods can be expressed as a constant DC offset plus an RF component that oscillates rapidly (with a typical frequency of about 1 MHz). The DC offset on the x-rods is positive so that a positive ion feels a restoring force that tends to keep it near the z-axis; the potential in the x-direction is like a well. Conversely, the DC offset on the y-rods is negative so that a positive ion feels a repulsive force that drives it further away from the z-axis; consequently, the potential in the x,y-plane is in the form of a saddle.

An oscillatory RF component is applied to both pairs of rods. The RF phase on the x-rods is the same and differs by 180 degrees from the phase on the y-rods. Ions move inertially along the z-axis from the entrance of the quadrupole to a detector often placed at the exit of the quadrupole. Inside the quadrupole, ions have trajectories that are separable in the x- and y-directions. In the x-direction, the applied RF field carries ions with the smallest mass-to-charge ratios out of the potential well and into the rods. Ions with sufficiently high mass-to-charge ratios remain trapped in the well and have stable trajectories in the x-direction; the applied field in the x-direction acts as a high-pass mass filter. Conversely, in the y-direction, only the lightest ions are stabilized by the applied RF field, which overcomes the tendency of the applied DC to pull them into the rods. Thus, the applied field in the y-direction acts as a low-pass mass filter. Ions that have both stable component trajectories in both x- and y-directions pass through the quadrupole to reach the detector.

In operation, the DC offset and RF amplitude applied to a quadrupole mass filter is chosen so as to transmit only ions within a restricted range of mass-to-charge (m/z) ratios through the entire length of the quadrupole. Such apparatuses can be operated either in the radio frequency (RF)-only mode or in an RF/DC mode. Depending upon the particular applied RF and DC potentials, only ions of selected m/z ratios are allowed to pass completely through the rod structures, whereas the remaining ions follow unstable trajectories leading to escape from the applied multipole field. When only an RF voltage is applied between predetermined electrodes, the apparatus serves to transmit ions in a wide-open fashion above some threshold mass. When a combination of RF and DC voltages is applied between predetermined rod pairs there is both an upper cutoff mass as well as a lower cutoff mass, such that only a restricted range of m/z ratios (i.e., a pass band) passes completely through the apparatus. As the ratio of DC to RF voltage increases, the transmission band of ion masses narrows so as to provide for mass filter operation, as known and as understood by those skilled in the art. As is further known, the amplitudes of the DC and RF voltages may be simultaneously varied, but with the DC/RF ratio held nearly constant but varied to maintain a uniform pass band, such that the pass band is caused to systematically "scan" a range of m/z ratios. Detection of the quantity of ions passed through the quadrupole mass filter over the course of such scanning enables generation of a mass spectrum.

Typically, such quadrupole mass filters are employed as a component of a triple stage mass spectrometer system. By way of non-limiting example, FIG. 1A schematically illustrates a triple-quadrupole system, as generally designated by the reference numeral 1. The operation of mass spectrometer 1 can be controlled and data 68 can be acquired by a control and data system (not depicted) of various circuitry of one or more known types, which may be implemented as any one or a combination of general or special-purpose processors (digital signal processor (DSP)), firmware, software to provide instrument control and data analysis for mass spectrometers and/or related instruments. A sample containing one or more analytes of interest can be ionized via an ion source 52 operating at or near atmospheric pressure. The resultant ions are directed via predetermined ion optics that often can include tube lenses, skimmers, and multipoles, e.g., reference characters 53 and 54, so as to be urged through a series of chambers, e.g., chambers 2, 3 and 4, of progressively reduced pressure that operationally guide and focus such ions to provide good transmission efficiencies. The various chambers communicate with corresponding ports 80 (represented as arrows in FIG. 1A) that are coupled to a set of vacuum pumps (not shown) to maintain the pressures at the desired values.

The example mass spectrometer system 1 of FIG. 1A is shown illustrated to include a triple stage configuration 64 within a high vacuum chamber 5, the triple stage configuration having sections labeled Q1, Q2 and Q3 electrically coupled to respective power supplies (not shown). The Q1, Q2 and Q3 stages may be operated, respectively, as a first quadrupole mass filter, a fragmentation cell, and a second quadrupole mass filter. Ions that are either filtered, filtered and fragmented or fragmented and filtered within one or more of the stages are passed to a detector 66. Such a detector is beneficially placed at the channel exit of the quadrupole (e.g., Q3 of FIG. 3) to provide data that can be processed into a rich mass spectrum 68 showing the variation of ion abundance with respect to m/z ratio.

During conventional operation of a multipole mass filter, such as the quadrupole mass filter Q3 shown in FIG. 1A, to generate a mass spectrum, a detector (e.g., the detector 66 of FIG. 1A) is used to measure the quantity of ions that pass completely through the mass filter as a function of time while the RF and DC voltage amplitudes are scanned. Thus, at any point in time, the detector only receives those ions having m/z ratios within the mass filter pass band at that time—that is, only those ions having stable trajectories within the multipole under the particular RF and DC voltages that are applied at that time. Such conventional operation creates a trade-off between instrument resolution (or instrument speed) and sensitivity. High mass resolving can be achieved, but only if the DC/RF ratio is such that the filter pass band is very narrow, such that most ions develop unstable trajectories within the mass filter and few pass through to the detector. Under such conditions, scans must be performed relatively slowly so as to detect an adequate number of ions at each m/z data point. Conversely, high sensitivity or high speed can also be achieved during conventional operation, but only by widening the pass band, thus causing degradation of m/z resolution.

U.S. Pat. No. 8,389,929, which is assigned to the assignee of the present invention and which is incorporated by reference herein in its entirety, teaches a quadrupole mass filter method and system that discriminates among ion species, even when both are simultaneously stable, by recording where the ions strike a position-sensitive detector as a function of the applied RF and DC fields. When the arrival times and positions are binned, the data can be thought of as a series of ion images. Each observed ion image is essentially the superposition of component images, one for each distinct m/z value exiting the quadrupole at a given time instant. The same patent also teaches methods for the prediction of an arbitrary ion image as a function of m/z and the applied field. Thus, each individual component image can be extracted from a sequence of observed ion images by mathematical deconvolution or decomposition processes, as further discussed in the patent. The mass-to-charge ratio and abundance of each species necessarily follow directly from the deconvolution or decomposition.

The inventors of U.S. Pat. No. 8,389,929 recognized that ions of different m/z ratios exiting a quadrupole mass filter may be discriminated, even when both ions are simultaneously stable (that is, have stable trajectories) within the mass filter by recording where the ions strike a position-sensitive detector as a function of the applied RF and DC fields. The inventors of U.S. Pat. No. 8,389,929 recognized that such operation is advantageous because when a quadrupole is operated in, for example, a mass filter mode, the scanning of the device that is provided by ramped RF and DC voltages naturally varies the spatial characteristics with time as observed at the exit aperture of the instrument. Specifically, ions manipulated by a quadrupole are induced to perform a complex 2-dimensional oscillatory motion on the detector cross section as the scan passes through the stability region of the ions. All ion species of respective m/z ratios express exactly the same motion, at the same Mathieu parameter "a" and "q" values, but at different respective RF and DC voltages and at different respective times. The ion motion (i.e., for a cloud of ions of the same m/z but with various initial displacements and velocities) may be characterized by the variation of a and q, this variation influencing the position and shape cloud of ions exiting the quadrupole as a function of time. For two masses that are almost identical, the sequence of their respective oscillatory motions is essentially the same and can be approximately related by a time shift.

The aforementioned U.S. Pat. No. 8,389,929 teaches, inter alia, a mass spectrometer instrument having both high mass resolving power and high sensitivity, the mass spectrometer instrument including: a multipole configured to pass an abundance of one or more ion species within stability boundaries defined by applied RF and DC fields; a detector configured to record the spatial and temporal properties of the abundance of ions at a cross-sectional area of the multipole; and a processing means. The data acquired by the so-configured detector can be thought of as a series of ion images. Each observed ion image is essentially the superposition of component images, one for each distinct m/z value exiting the quadrupole at a given time instant. The aforementioned patent also provides for the prediction of an arbitrary ion image as a function of m/z and the applied field. As a result, each individual component can be extracted from a sequence of observed ion images by mathematical deconvolution or decomposition processes which generate the mass-to-charge ratio and abundance of each species. Accordingly, high mass resolving power may be achieved under a wide variety of operating conditions, a property not usually associated with quadrupole mass spectrometers.

The teachings of the aforementioned U.S. Pat. No. 8,389,929 exploit the varying spatial characteristics by collecting the spatially dispersed ions of different m/z even as they exit the quadrupole at essentially the same time. FIG. 1B shows a simulated recorded image of a particular pattern at a particular instant in time. The example image can be collected by a fast detector, (i.e., a detector capable of time resolution of 10 or more RF cycles, more often down to an RF cycle or with sub RF cycles specificity, where said sub-RF specificity is possibly averaged for multiple RF cycles), positioned to acquire where and when ions exit and with substantial mass resolving power to distinguish fine detail. When an ion, at its (q, a) position, enters the stability region during a scan, the y-component of its trajectory changes from "unstable" to "stable". Watching an ion image formed in the exit cross section progress in time, the ion cloud is elongated and undergoes wild vertical oscillations that carry it beyond the top and bottom of a collected image. Gradually, the exit cloud contracts, and the amplitude of the y-component oscillations decreases. If the cloud is sufficiently compact upon entering the quadrupole, the entire cloud remains in the image, i.e. 100% transmission efficiency, during the complete oscillation cycle when the ion is well within the stability region.

As the ion approaches the exit of the stability region, a similar effect happens, but in reverse and involving the x-component rather than the y-component. The cloud gradually elongates in the horizontal direction and the oscillations in this direction increase in magnitude until the cloud is carried across the left and right boundaries of the image. Eventually, both the oscillations and the length of the cloud increase until the transmission decreases to zero.

FIG. 1B graphically illustrates such a result. In particular, the vertical cloud of ions, as enclosed graphically by the ellipse 6 shown in FIG. 1B, correspond to the heavier ions entering the stability diagram, as described above, and accordingly oscillate with an amplitude that brings such heavy ions close to the denoted y-quadrupoles. The cluster of ions enclosed graphically by the ellipse 8 shown in FIG. 1B correspond to lighter ions exiting the stability diagram and thus cause such ions to oscillate with an amplitude that brings such lighter ions close to the denoted x-quadrupoles.

Within the image lie the additional clusters of ions (shown in FIG. 1B but not specifically highlighted) that have been collected at the same time frame but which have a different exit pattern because of the differences of their a and q parameters.

FIG. 1C illustrates one example of a time and position ion detector system, generally designated by the reference numeral 20 as described in the aforementioned U.S. Pat. No. 8,389,929. As shown in FIG. 1C, incoming ions I (shown directionally by way of accompanying arrows) having for example a beam cross section of about 1 mm or less, varying to the quadrupole's inscribed radius as they exit from an ion occupation volume between quadrupole rod electrodes 101, are received by an assembly of microchannel plates (MCPs) 13. Such an assembly can include a pair of MCPs (a Chevron or V-stack) or triple (Z-stack) comprising MCPs adjacent to one another with each individual plate having sufficient gain and resolution to enable operating at appropriate bandwidth requirements (e.g., at about 1 MHz up to about 100 MHz) with the combination of plates generating many tens of electrons in response to each incident ion.

To illustrate operability by way of an example, the first surface of the MCP assembly 13 can be floated to 10 kV, (i.e., +10 kV when configured for negative ions and −10 kV when configured to receive positive ions), with the second surface floated to +12 kV and −8 kV respectively, as shown in FIG. 1C. Such a plate biasing provides for a 2 kV voltage gradient to provide the gain with a resultant output relative 8 to 12 kV relative to ground. All high voltages portions are under vacuum between about $10^{-5}$ mBar ($10^{-3}$ Pa) and $10^{-6}$ mBar ($10^{-4}$ Pa).

The example biasing arrangement of FIG. 1C thus enables impinging ions I as received from, for example, the exit of a quadrupole, as discussed above, to induce electrons in the front surface of the MCP 13 for the case of positive ions, that are thereafter directed to travel along individual channels of the MCP 13 as accelerated by the applied voltages. As known to those skilled in the art, since each channel of the MCP serves as an independent electron multiplier, the input ions I as received on the channel walls produce secondary electrons (denoted as $e^-$). This process is repeated several times by the potential gradient across both ends of the MCP stack 13 and a large number of electrons are in this way released from the output end of the MCP stack 13 to substantially enable the preservation of the pattern (image) of the particles incident on the front surface of the MCP. When operated in negative ion mode, negative ions are initially converted to small positive ions that then induce a similar electron cascade as is well known in the art.

The biasing arrangement of the detector system 20 (FIG. 1C) also provides for the electrons multiplied by the MCP stack 13 to be further accelerated in order to strike an optical component, e.g., a phosphor coated fiber optic plate 15 configured behind the MCP stack 13. Such an arrangement converts the signal electrons to a plurality of resultant photons (denoted as p) that are proportional to the amount of received electrons. Alternatively, an optical component, such as, for example, an aluminized phosphor screen can be provided with a biasing arrangement (not shown) such that the resultant electron cloud from the MCP 13 stack can be drawn across a gap by the high voltage onto a phosphor screen where the kinetic energy of the electrons is released as light. The initial assembly is configured with the goal of converting either a positive or negative ion image emanating from the quadrupole exit into a photon image suitable for acquisition by subsequent photon imaging technology.

The photons p emitted by the phosphor coated fiber optic plate or aluminized phosphor screen 15 are captured and then converted to electrons which are then translated into a digital signal by a two-dimensional camera component 25 (FIG. 1C). In the illustrated arrangement, a plate, such as, a photosensitive channel plate 10 assembly (shown with the anode output biased relative to ground) can convert each incoming photon p back into a photoelectron. Each photoelectron generates a cloud of secondary electrons 11 (indicated as $e^-$) at the back of the photosensitive channel plate 10, which spreads and impacts as one arrangement, an array of detection anodes 12, such as, but not limited to, an two-dimensional array of resistive structures, a two-dimensional delay line wedge and strip design, as well as a commercial or custom delay-line anode readout. As part of the design, the photosensitive channel plate 10 and the anodes 12 are in a sealed vacuum enclosure (not shown).

Each of the anodes of the two-dimensional camera 25 shown in FIG. 1C can be coupled to an independent amplifier 14 and additional analog to digital circuitry (ADC) 18 as known in the art. For example, such independent amplification can be by way of differential transimpedance amplifiers to amplify and suppress noise and transform detected current into voltage. The signals resultant from amplifiers 14 and analog to digital circuitry (ADC) 18 and/or charge integrators (not shown) can eventually be directed to a Field Programmable Gate Array (FPGA) 22 via, for example, a serial LVDS (low-voltage differential signaling) high-speed digital interface 21, which is a component designed for low power consumption and high noise immunity for the data rates of the present invention. The FPGA 21, when electrically coupled to a computer or other data processing means 26, may be operated as an application-specific hardware accelerator for the required computationally intensive tasks.

The ion imaging application described in U.S. Pat. No. 8,389,929 and under consideration herein requires high sensitivity and high signal linearity over a wide dynamic range. The two-dimensional anode array camera 25 shown in FIG. 1B provides such characteristics but requires custom fabrication. To reduce complexity, it would be desirable, for many applications, to replace the anode array camera by a commercially available alternative. Therefore, the present disclosure provides, according to some embodiments described herein, less-complex alternatives to the previously disclosed anode array camera. For some other applications that require superior performance, it would be desirable to replace the diode array camera by a more-sensitive alternative. Therefore, the present disclosure also provides, according to some other embodiments described herein, alternative imaging systems which provide higher performance, especially for very weak ion fluxes, than the previously disclosed anode array camera.

Some system embodiments in accordance with the present invention include image intensifiers of novel design. Various image-intensifier technologies have been developed for use in commercial applications. The earliest cascaded image intensifier is based upon "generation 1" technology in which there is no micro channel plate but, instead, only a low work function coating on the entrance surface of a vacuum vessel that converts incoming photons to free electrons. As such generation-1 applications involve human vision, the internal electrostatic optics inverts the electron beam to create an upright image on a phosphor coated exit. Although such technology has found application in vehicle mounted systems, it is associated with a large physical size that is unacceptable for use with the mass spectrometer systems under consideration in the present disclosure.

U.S. Pat. No. 3,875,440 issued Apr. 1, 1975 describes a cascaded intensifier in which one side of a mica plate is coated with a photocathode material and the other with a phosphor. To form a cascaded image intensifier, a series of such parts are placed end-to-end and sealed into glass cylinders which are then evacuated. The mica tolerates 10 kV so the optocoupler arrangement allows multiple stages to operate with this single supply voltage.

A more recent patent, U.S. Pat. No. 6,958,474 dated Oct. 25, 2005 describes an ion detector for a time of flight mass spectrometer. While this application does not involve imaging or cascading multiple stages, specific advantages of using the phosphor as a gain stage are described, as well as a number of detailed design enhancements.

A problem that leads to premature photocathode wear is bombardment by positive ions produced by ionization of background gases. These ions are accelerated back towards the photocathode. U.S. Pat. No. 6,483,231 dated Nov. 19, 2002 assigned to Litton Industries describes this phenomenon and a means to eliminate it where the source is a micro-channel plate. By controlling dimensions, close spacing is provided, which reduces the ion formation such that a common image intensifier barrier film that blocks ions from leaving the MCP is not required.

SUMMARY

In accordance with some ion imaging system embodiments, a cascaded phosphor imaging system is employed as a gain stage. The cascaded system can eliminate the need for a high gain micro channel plate, which can be replaced by either a low gain micro channel plate or another type of ion to electron conversion dynode, such as a metal channel dynode (MCD). The described novel ion imaging systems employing MCDs are associated with an increase in dynamic range over the strip current limited range achieved by typical MCPs. Further, taking into account system maintenance costs, replacing the conventional MCP by an MCD is expected to decrease long-term system cost. Although an MCD device is (as of this writing) more costly than a comparable single MCP device, the MCD is expected to have substantially longer lifetime, as the MCP is generally the most fragile component of MCP-phosphor based systems. Therefore, using an MCD is expected to provide a long-term system cost benefit.

The present inventors have realized that various alternative camera technologies may be employed, in accordance with some embodiments, as a less costly and less complex alternative, relative to the previously-described camera. By way of non-limiting example, such camera technologies include charge-coupled device (CCD), charge injection device (CID) complementary metal-oxide-semiconductor (CMOS) and silicon photomultiplier array technologies. In regard to the present application, the inventors contemplate the use of a detector system that is designed to observe signal with a resolution of 187 microns and a time specificity of 125 nanoseconds. This low gain and resolution requirement creates the opportunity to exploit alternative image-intensifier geometries other than those created for the typical applications noted above.

Using the gain characteristics of CID camera systems as an example and using the expected quantities of ions to be detected in the mass analyzer systems under consideration, the inventors calculate that between $10^3$ and $10^5$ photons must be generated for each incident ion. The photon generation system described in U.S. Pat. No. 8,389,929 comprises a microchannel plate (MCP) and a phosphor-coated substrate. Conventionally, such multi-component signal conversion systems are designed most of the signal gain is generated in the first component which, in the system shown in FIG. 1B, is the MCP. Unfortunately, however, available MCPs are associated with only a relatively small dynamic range within which the number of generated electrons is sufficiently linear, for purposes of the present application, with the number of incident ions. The MCP linearity range is restricted, at the high end (at approximately 10% gain), by the limited capacity of inter-channel strip current to re-supply ejected electrons to the channel lumens. As a result, MCPs can readily saturate if the incoming signal focuses on just a few channels. Moreover, the linearity or sensitivity (or both) of MCPs may be degraded, at low gain settings, as a result of a minimum gain required to generate a non-zero supply of secondary electrons during a number of generations of secondary electron formation just subsequent to the first formation of secondary electrons upon initial ion impact. Accordingly, the inventors of the present application have realized that, for purposes of the ion spatial and temporal imaging system presently under consideration, it is desirable to replace the conventional MCP by an ion-to-electron converter of lower gain and to generate the quantity of photons required by a CID, CCD, CMOS, etc. detector system by amplification of the photonic signal. The ion-to-electron converter may comprise, for example, a low-gain multichannel plate or a metal channel dynode.

The present inventors have further realized that a two-dimensional array of silicon photomultipliers may be employed, in accordance with some embodiments, as a high-performance alterative to the previously-described camera system. In such systems, the array of anodes of the previously-disclosed system is replaced with a two-dimensional array of silicon photomultipliers. Each micro sensor is a high gain (e.g., up to $10^6$ gain in some implementations, with a gain range of $10^5$ to $10^6$ gain being typical for the present application) avalanche detector with a relatively rapid response and recovery. An alternative mass spectrometer detection system configuration employing a pair of one-dimensional silicon photomultiplier arrays (instead of a two-dimensional array) may also be employed. One such configuration is described in a co-pending and commonly-assigned United States patent application titled "Recording Spatial and Temporal Properties of Ions Emitted from a Quadropole Mass Filter" (U.S. Application Ser. No. 14/561,166), filed on Dec. 4, 2014. Silicon photomultiplier array detector systems are available as arrays of low-voltage avalanche photodiodes in pitch sizes of 10 μm, 20 μm, 30 μm and larger. Such an imaging system is expected to provide superior performance. Because of the high-gain characteristics of the camera system, high-gain characteristics are not required of either the micro channel plate (MCP) or the photon generating assembly (comprising the phosphor coated fiber optic plate 15 shown in FIG. 1B). Instead, a low-gain photonic signal may be input to the silicon photomultiplier array that is then employed to detect the photons and provide an amplified electronic signal. This amplified electronic signal may be provided at a level that is easily measured with a low-cost transimpedance amplifier and analog-to-digital converter (ADC). Such systems may employ a single phosphor coated plate and an ion-to-electron converter of lower gain than that of a conventional multichannel plate, such as a low-gain multichannel plate or a metal channel dynode.

BRIEF DESCRIPTION OF THE DRAWINGS

The above noted and various other aspects of the present invention will become further apparent from the following description which is given by way of example only and with reference to the accompanying drawings, not drawn to scale, in which.

DETAILED DESCRIPTION

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the FIGS. 1A, 1B, 2A, 2B, 2C, 3, 4A, 4B, 5A and 5B, taken in conjunction with the following description.

Figure 1A:
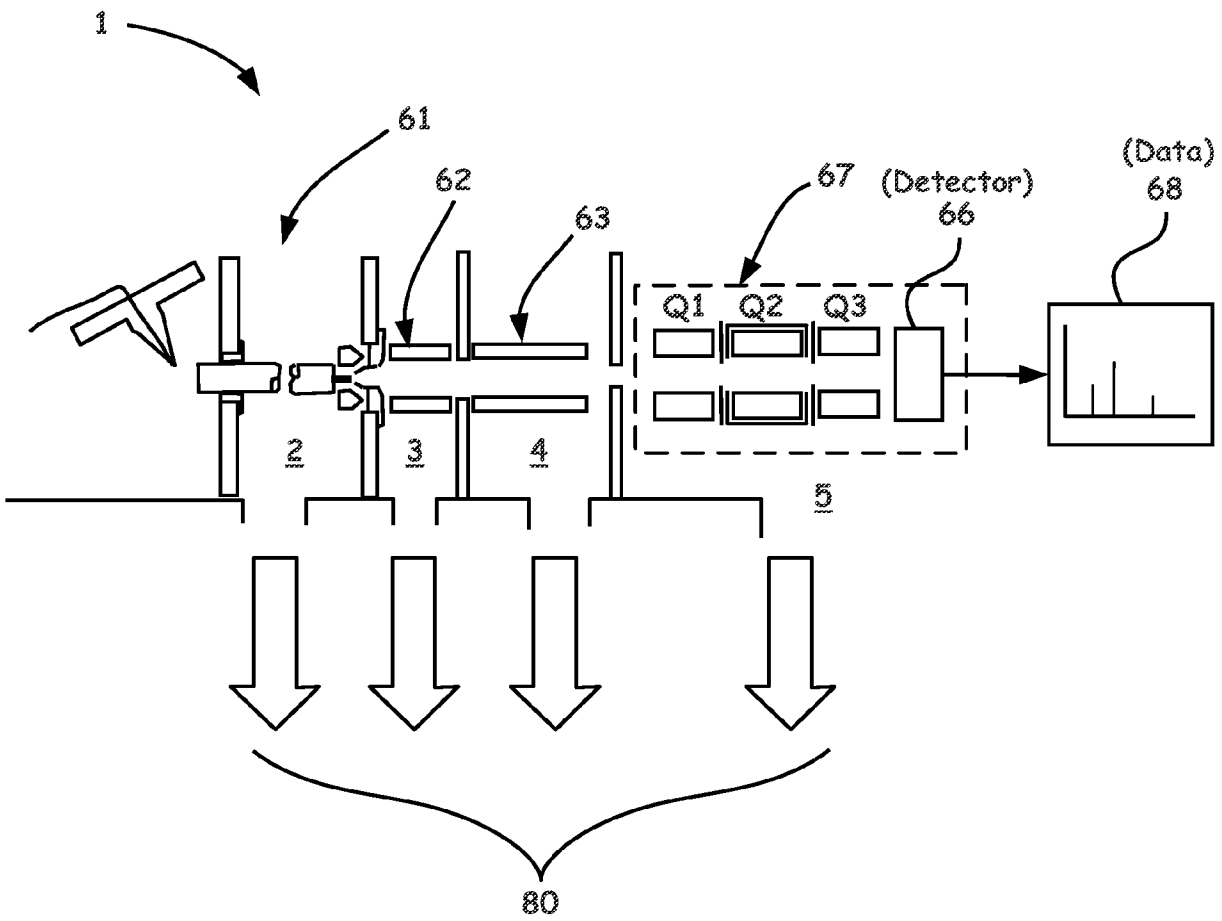
FIG. 1A (Prior Art)
FIG. 1A is a schematic example configuration of a triple stage mass spectrometer system.
Figure 1B:
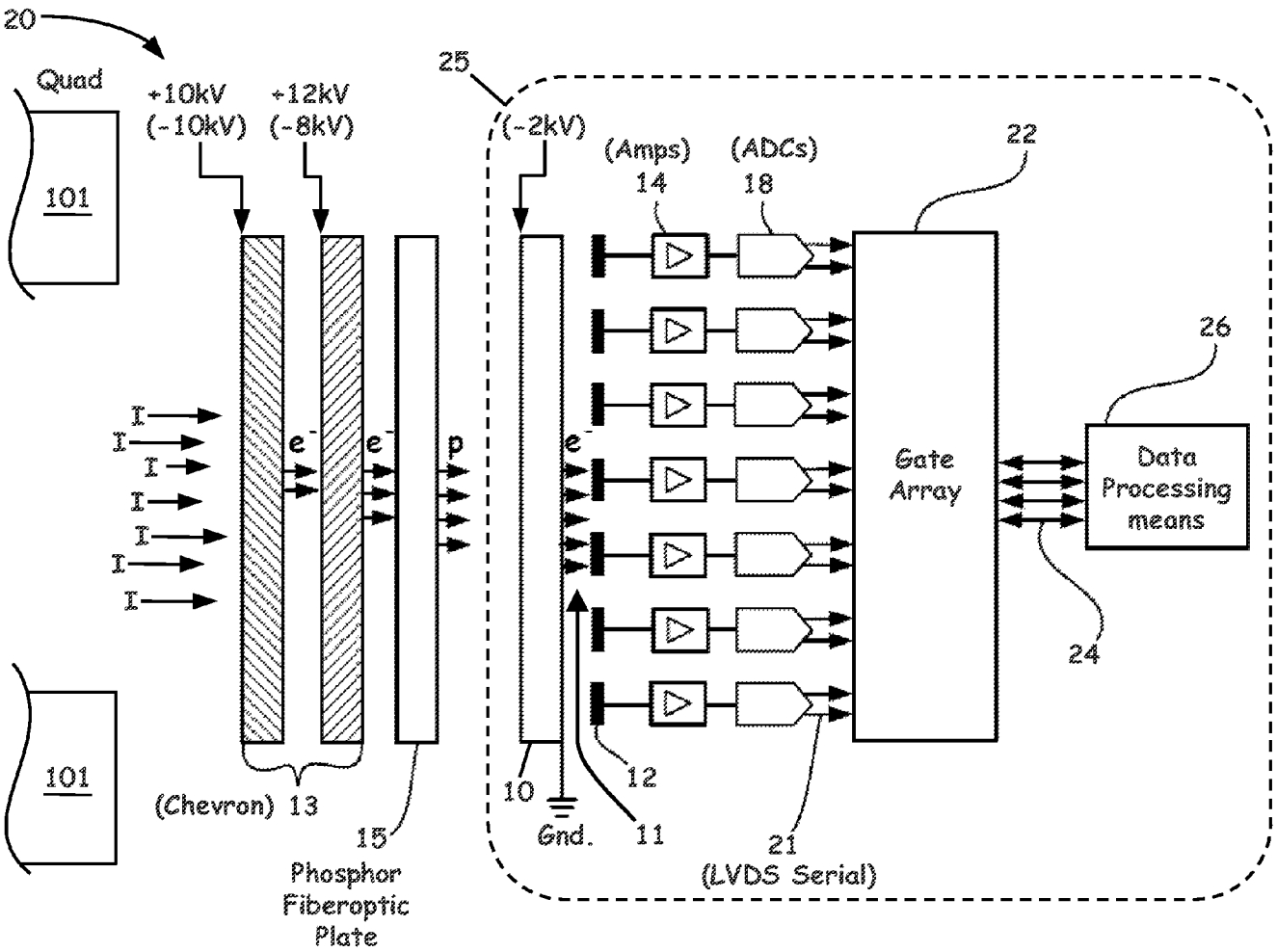
FIG. 1B (Prior Art)
FIG. 1B is an example embodiment of a time and position ion detector system configured with an array of read-out anodes.
Figure 2A:
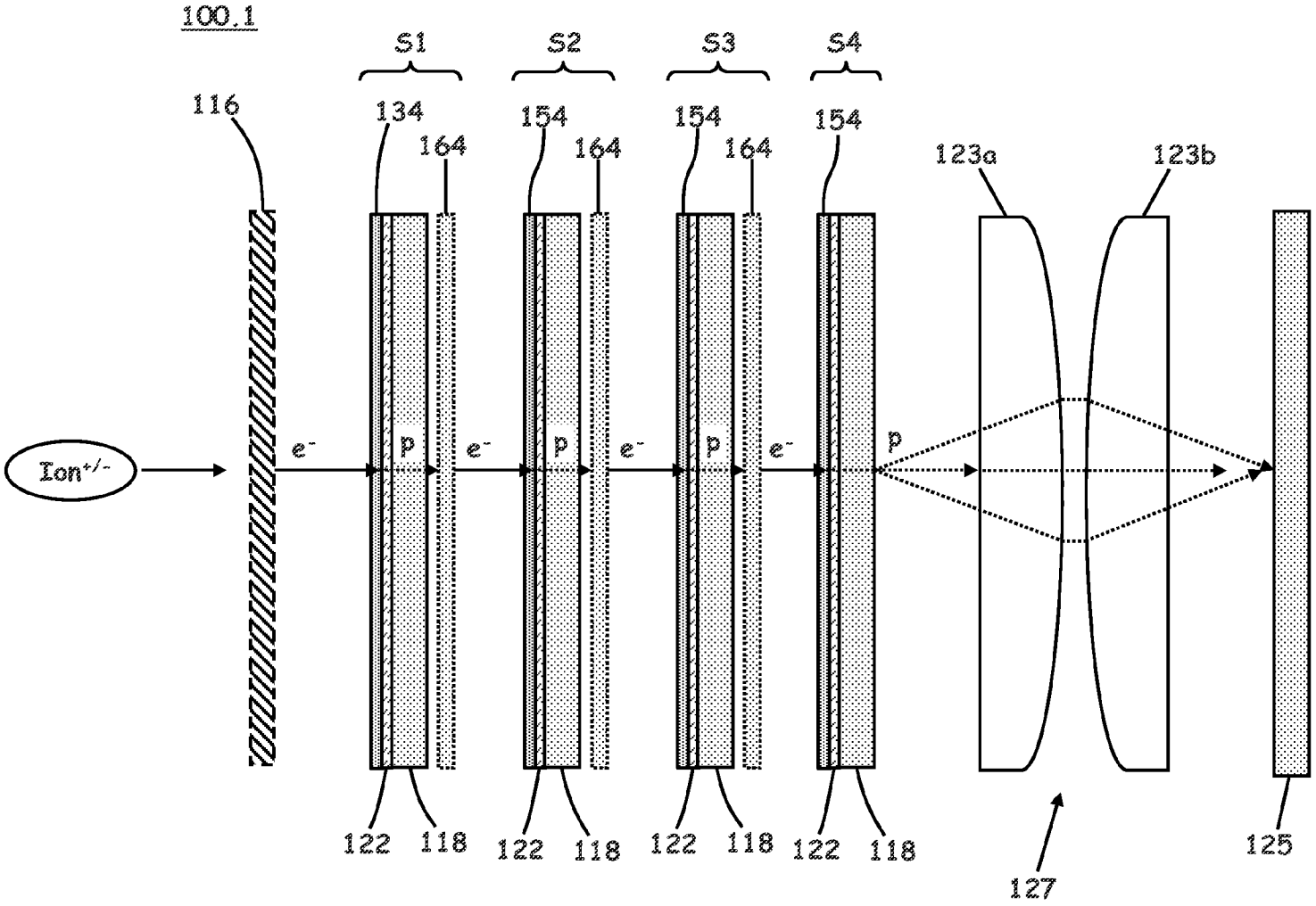
FIG. 2A is a schematic illustration of a first detector system, in accordance with the present teachings, for a mass spectrometer and having a cascaded-optical-gain section.

FIG. 2A is a schematic illustration of a first detector system, in accordance with the present teachings, for a mass spectrometer. The detector system 100.1 illustrated in FIG. 2A includes a metal channel dynode (MCD) 116 that serves to generate secondary electrons in proportion to ions that exit the mass spectrometer and a plurality of phosphor-based gain stages. In the example shown in FIG. 2A, four such gain stages S1-S4 are illustrated. However, the number of gain staged employed need not be restricted to any particular number of stages.

In operation of the detector system 100.1, ions (either positive or negative) are accelerated in the direction of the MCD 116 by application of an electrical potential difference between an electrode of the mass spectrometer (not shown) and the MCD 116 or between the MCD 116 and a an electrode 134 of the first gain stage S1, or both. The electrical potential difference is such as to provide ion impact energy of at least several kilo electron volts. For positive ions a typical value would be −10 kV. Secondary electrons, $e^-$, generated at the MCD are accelerated in the direction of a phosphor coating 122 disposed on a substrate plate 118 of the first gain stage S1 by application of an electrical potential difference between the MCD 116 and an electrode 134 comprising a thin conductive metallic coating disposed on the phosphor 122. This metal coating allows high energy electrons to pass and induce photon production in the phosphor. Further, the coating is optically reflective and increases the efficiency of the phosphor by redirecting back-emitted or backscattered photons towards the thin insulating glass, mica, plastic or preferably fiber optic substrate plate 118.

At the phosphor 122 of the first stage S1, the kinetic energy of the electrons is converted to radiant energy of emitted photons p by cathodoluminescence. Thus, the substrate plate 118 and its phosphor coating 122, taken together, may be considered to comprise an "electron-to-photon" converter. Alternatively, the combination of substrate plate 118, phosphor coating 122 and electrode 134, when taken together, may be considered to comprise the electron-to-photon converter, since these three components will generally—but not necessarily always—occur together. The similar components of gain stages S1, S2 and S3 may be regarded, similarly, as additional electron-to-photon converters. Some of the photons p emitted by phosphor 122 propagate through the substrate plate 118 of gain stage S1 and are absorbed by a photocathode 164 of the same stage. Although each photocathode 164 is shown in the drawings as separated from its associated substrate plate 118, it may be provided as a coating on the back face of the substrate plate. At the photocathode, a portion of the photon energy is converted back to kinetic energy of electrons $e^-$. Thus, each photocathode 164 may be regarded as an electron-to-photon converter.

The electrons generated at the first gain stage S1 are accelerated so as to impact the phosphor coating 122 disposed on a substrate plate 118 of the second gain stage S2 by application of an electrical potential difference between the photocathode 164 of stage S1 and a thin-film metallic electrode 154 disposed on the phosphor 122 of the second gain stage S2. The process of generating photons from the electrons and generating new electrons from the photons, and causing the new electrons to propagate toward the next stage is repeated at stages S2 and S3. More generally, this process is repeated at each gain stage except for the last stage. The final gain stage—stage S4 in the example illustrated in FIG. 2A—does not include a photocathode component. Thus, the output of the final stage is a population of photons.

The final population of photons (i.e., the population of photons generated by cathodoluminescence at the last gain stage) may be focused a light detector 125 by a lens assembly 127. In some embodiments, the light detector is provided as a two-dimensional detector, such as a charge-coupled-device (CCD) camera or, a charge injection device (CID) camera, a camera based on complementary metal-oxide-semiconductor technology or as an array of silicon photomultiplier detectors. In alternative embodiments, the detector may be a single channel photo detector to enable simple ion detection. Since the cathodoluminescence may consist of broadband light, an achromatic lens assembly is preferred. In the illustrated example, the lens assembly comprises lens elements 123*a*, 123*b*. Alternatively, the lens doublet could also be replaced by direct coupling of the detector to the fiber optic plate (if employed) or other phosphor-coated substrate plate or other scintillating material of the final gain stage.

Figure 4A:
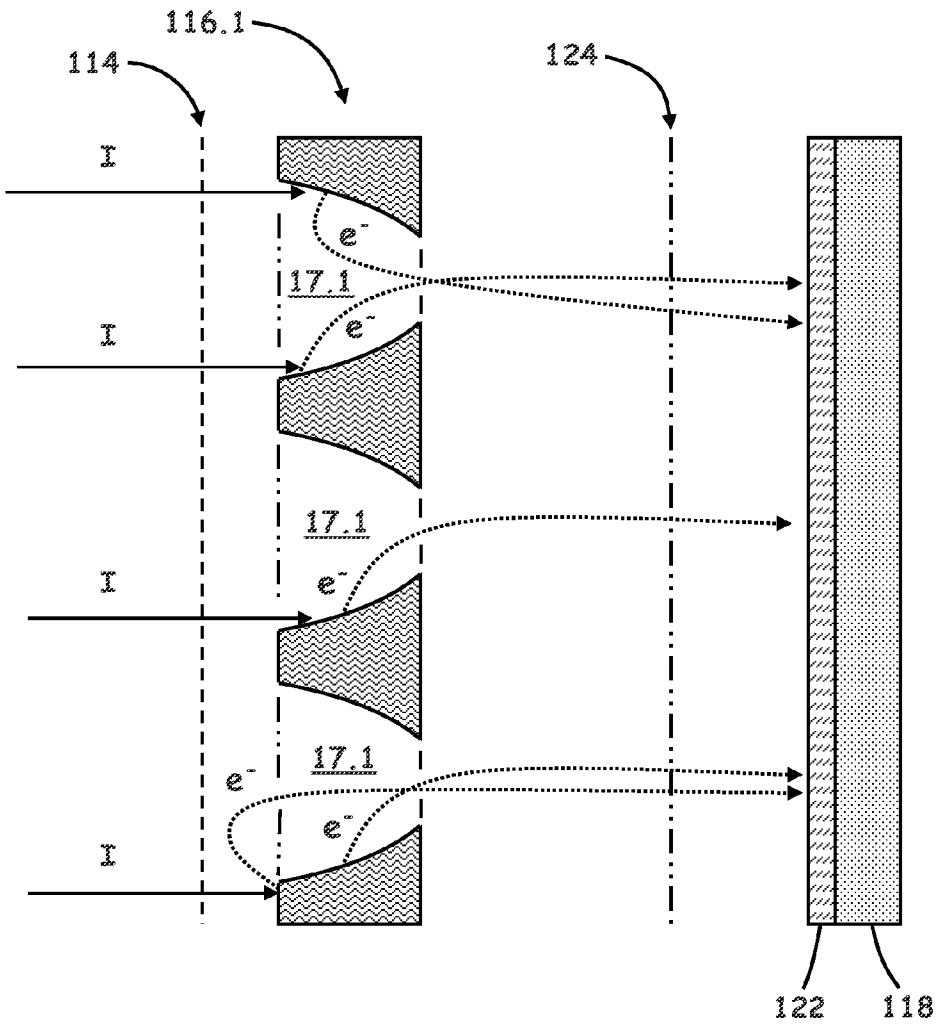
FIG. 4A is a schematic cross-sectional illustration of a first metal channel dynode element as may be employed in detector systems in accordance with the present teachings.
Figure 4B:
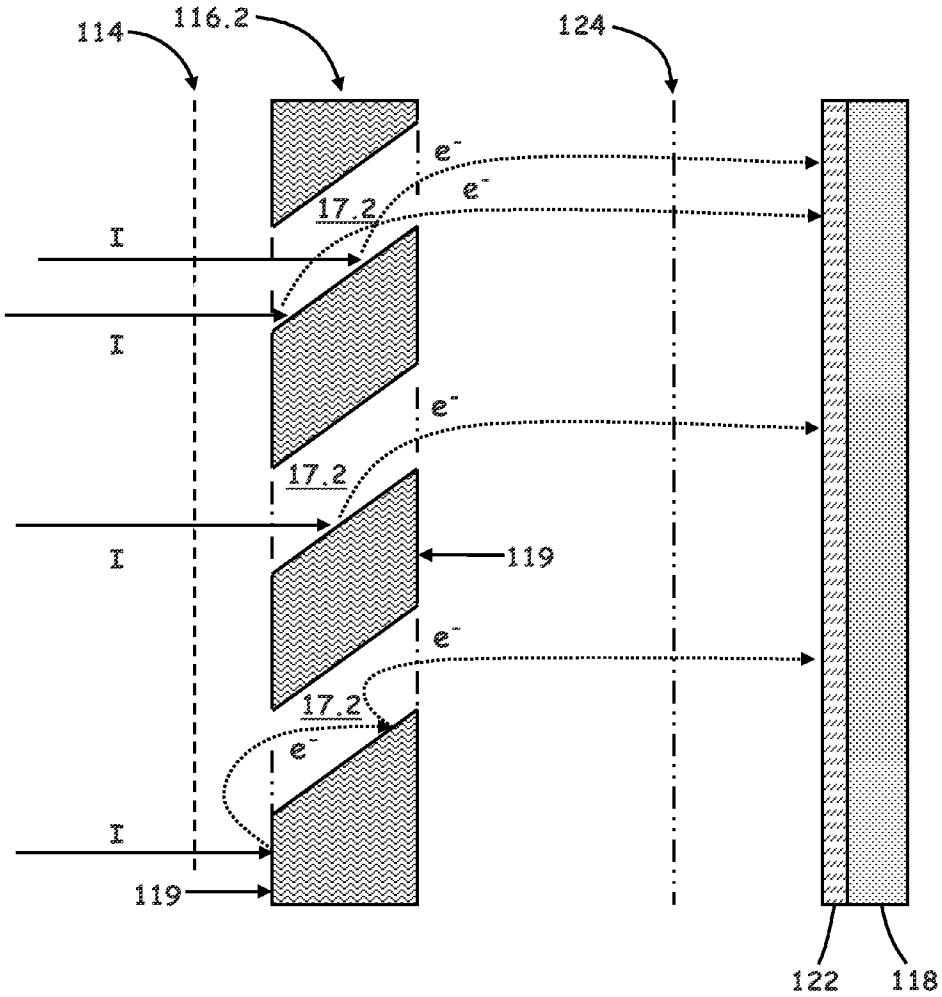
FIG. 4B is a schematic cross-sectional illustration of a second metal channel dynode element as may be employed in detector systems in accordance with the present teachings.

FIGS. 4A-4B illustrate, in cross section, two different MCD configurations, shown as MCD 116.1 and MCD 116.2 in FIGS. 4A and 4B, respectively. Each MCD comprises a metal plate having a plurality of perforations or channels, shown as perforations 17.1 and 17.2 in FIGS. 4A and 4B, respectively. At the MCD, ions I are neutralized by impact with the metal plate or with the interior walls of the perforations or channels and at least a portion of their kinetic energy is released as kinetic energy of ejected secondary electrons $e^-$. If the metal channel dynode is coated with an appropriate enhancer substance such as magnesium oxide or any other enhancer (generally, a metal oxide), the conversion efficiency should be as good as the input surface of an MCP. The fragile and expensive MCP of conventional systems can therefore be eliminated.

The MCD 116.1 illustrated in FIG. 4A is in the form of a shadow mask, as has been employed in the cathode ray tubes of first-generation color televisions. Although this shadow mask configuration is suitable for use in the present application, it presents a partial direct line of sight between the source of ions and the phosphor 122 on the first substrate 118. This configuration thus allows for the possibility that some proportion of the ions I may pass completely through the MCD 116.1 without conversion to electrons, thereby causing some loss of gain. The alternative "Venetian blind" configuration of the MCD 116.2 shown in FIG. 4B comprises channels 17.2 that are angled relative to the front and back faces 119 of the metal plate. Through an appropriate choice of channel spacing, width and angle, the channels may be configured such that there is no direct line of sight through the dynode taken along a line perpendicular to the faces 119. The angled channels 17.2 shown in FIG. 4B may be formed by laser cutting through an originally solid metal plate, by electrical discharge machining or by electroforming. In this variant (FIG. 4B), channels or apertures made by any of the various means resemble a short length-to-diameter-ratio micro channel plate. It is desirable to manufacture such a plate with a high open area ratio. A hexagonal pattern of holes is the best pattern for round holes, but other hole variants, such as squares can be packed with a square pattern. This pattern would resemble a Venetian blind design with cross ribs to stabilize the structure.

The MCD devices illustrated in FIGS. 4A-4B are only two possible examples. A variety of other aperture shapes, sizes, patterns and spacings are possible. It is also possible to provide a multiple-plate MCD device in which each plate comprises apertures of a certain size and pattern and the multiple plates are disposed such that there exists an offset between apertures of adjacent plates. Voltage steps may be applied between the various plates.

If positively charged ions are emitted from the mass analyzer, then the process of forcing secondary electrons through a single electroformed MCD plate is relatively easy. However, if the ions are negatively charged, then the electrical potential bias relative to the subsequent phosphor needs to be arranged such that the resulting electric field sufficiently penetrates the apparatus so as to keep the overall quantum efficiency of the first conversion stage sufficiently high to compete with that of an MCP.

Signal gain generated by the detector system 100.1 (FIG. 2A) is derived almost exclusively by cathodoluminescence at the series of phosphors. The gain of the MCD is very low, producing only a few secondary electrons (e.g., fewer than 10 electrons) in response to each incident ion. The quantum efficiency of photocathodes ranges from about 20% to 60%; therefore, each of the photocathodes 164 has less-than-unity-gain. Each of the phosphors 122, however, can provide a substantial gain. Each such phosphor can generate anywhere from 10 to 400 photons per incident electron, depend upon the electron energy. Assuming a photocathode quantum efficiency of 20% and a gain of 50× for each phosphor, the net gain of each one the stages S1-S4 is approximately one order of magnitude. Three such stages can produce a gain of 1000. Four stages can provide the gain of $10^4$ that is required, as described above, for operating the CID detector 125 in the mass spectrometer detector system 100.1.

Each of the substrate plates 118 may comprise a single-piece or integral component, such as a plate made of glass, mica or plastic. Alternatively, each substrate plate may be formed as a fiber optic plate, which is an optical device comprised of a bundle of densely packed parallel optical fibers, each of micron size, with the set of fiber first ends and the set of fiber back ends each terminated and polished so as to essentially form parallel front and back faces, respectively. Such fiber optic plates are used in various applications including transferring images, possibly magnified or reduced in size, and are commercially available from Hamamatsu Photonics K.K. of Iwata City Japan. According to some alternative embodiments, one or more substrate plates may be provided as a thin scintillating plastic, thereby eliminating the need for a phosphor coating.

Note that the bias electrical potential that is applied to the electrode 134 disposed on the first gain stage S1 must be relative to the MCD 116 (or other ion to electron conversion device), but the downstream electrical potential biases (on photocathodes 164 and electrodes 154) are not similarly constrained. For convenience these downstream electrical potentials may be driven by common voltages, but such operation is not required. The use of common voltages simply reduces the power supply requirements. For example, the MCD bias might limit the gradient to the first phosphor, especially in the case of negative ions. Once the ion signal is converted to photons, the subsequent gain stages may be driven with higher potentials and therefore, higher gain.

The electrodes 134, 154 and photocathodes 164 may be formed as thin, flat plates or films disposed on or adjacent to the substrates. Such flat, parallel surfaces can produce a strong electric field gradient that will overcome the natural angular dispersion of the electrons and maintain the propagation of each packet of electrons between stages parallel to the long axis of the system. If the substrate used is a very small dimensioned fiber optic plate, the photon dispersion may be similarly controlled. The unavoidable image blurring that multiple stages will incur can be controlled by use of a fiber optic plate so as to easily match the desired pixel spatial resolution (for example, 187 μm) of a suitable camera 125. If the substrate plates 118 are formed from a non-fiber material (for instance, as a plate or sheet of glass, mica or plastic), then image blurring and stray light effects may be prevented by incorporating optical lenses (not shown) within one or more of the gain stages so as to transfer an image of the light emission pattern of each phosphor 122 to the respective photocathode 164.

Figure 2B:
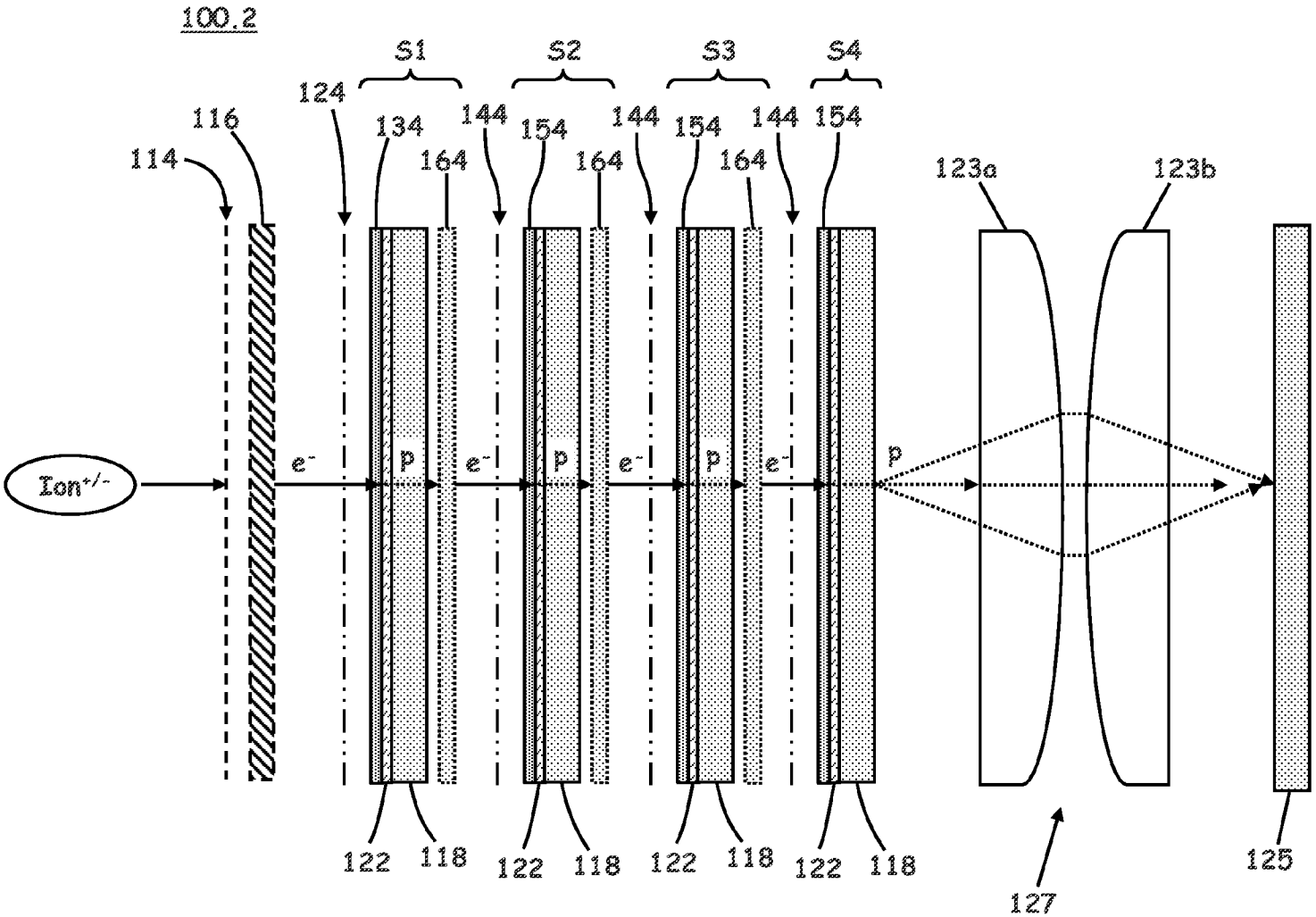
FIG. 2B is a schematic illustration of a second detector system, in accordance with the present teachings, for a mass spectrometer and having a cascaded-optical-gain section.

FIG. 2B is a schematic illustration of a second detector system in accordance with the present teachings. The detector system 100.2 illustrated in FIG. 2B is generally similar to the detector system 100.1 shown in FIG. 2A but includes additional optional enhancement features relative to the detector system 100.1. The enhancement features may be provided together as shown or, alternatively, individually.

The first such optional enhancement feature shown in FIG. 2B is an optional grid electrode 114 that is biased negatively to the MCD 116 (or other alternative ion-to-electron converter) so as to repel any back scattered electrons into the MCD or other ion-to-electron converter. Electrons that exit the MCD or other ion-to-electron converter are thus directed towards the first phosphor layer 122.

Still with reference to FIG. 2B, the illustrated set of optional grid electrodes 124, 144 disposed between each phosphor and the electron source that provides electrons to the phosphor is a second optional enhancement feature. The grid electrode 124 is disposed between the phosphor 122 of the first gain stage S1 and its source of electrons, the MCD 116. The grid electrodes 144 are disposed between gain stages, whereby the source of electrons for the phosphor 122 of each succeeding gain stage is the photocathode 164 of the immediately preceding gain stage. Each grid electrode 124, 144 receives, in operation, an electrical potential that is positively biased relative to the phosphor of the succeeding gain stage. These grid electrodes serve, in operation, to reduce premature photocathode wear that may be caused by bombardment by secondary positive ions produced by ionization of background gases or by electron bombardment at the phosphor's metallization surface and accelerated towards the photocathodes in a direction opposite to the flow of electrons. Such secondary positive ions are created with low energy and cannot overcome the local field generated at the grid electrodes 124, 144. Incoming electrons will be decelerated slightly at these grid electrodes, but their incoming energy will easily overcome the potential barrier. The secondary positive ions are thus propelled back towards the metal electrode layers 134, 144. A very open grid form will suffice for this purpose.

Since the detector system 100.1 (FIG. 1A) and the detector system 100.2 (FIG. 1B) as well as other detector systems disclosed herein are designed for use with a mass spectrometer, an integrated vacuum vessel is not required provided that the particular photocathode and phosphors that are employed are tolerant to exposure to air during shipment. Under such circumstances, the herein disclosed detector systems may be assembled from discrete components at the time that a mass spectrometer system is assembled and disposed within the high vacuum chamber 5 of the mass spectrometer system (see FIG. 1). In this fashion, the novel detector system, as disclosed herein, may replace the conventional mass spectrometer detector 66 within the high vacuum chamber.

Figure 2C:
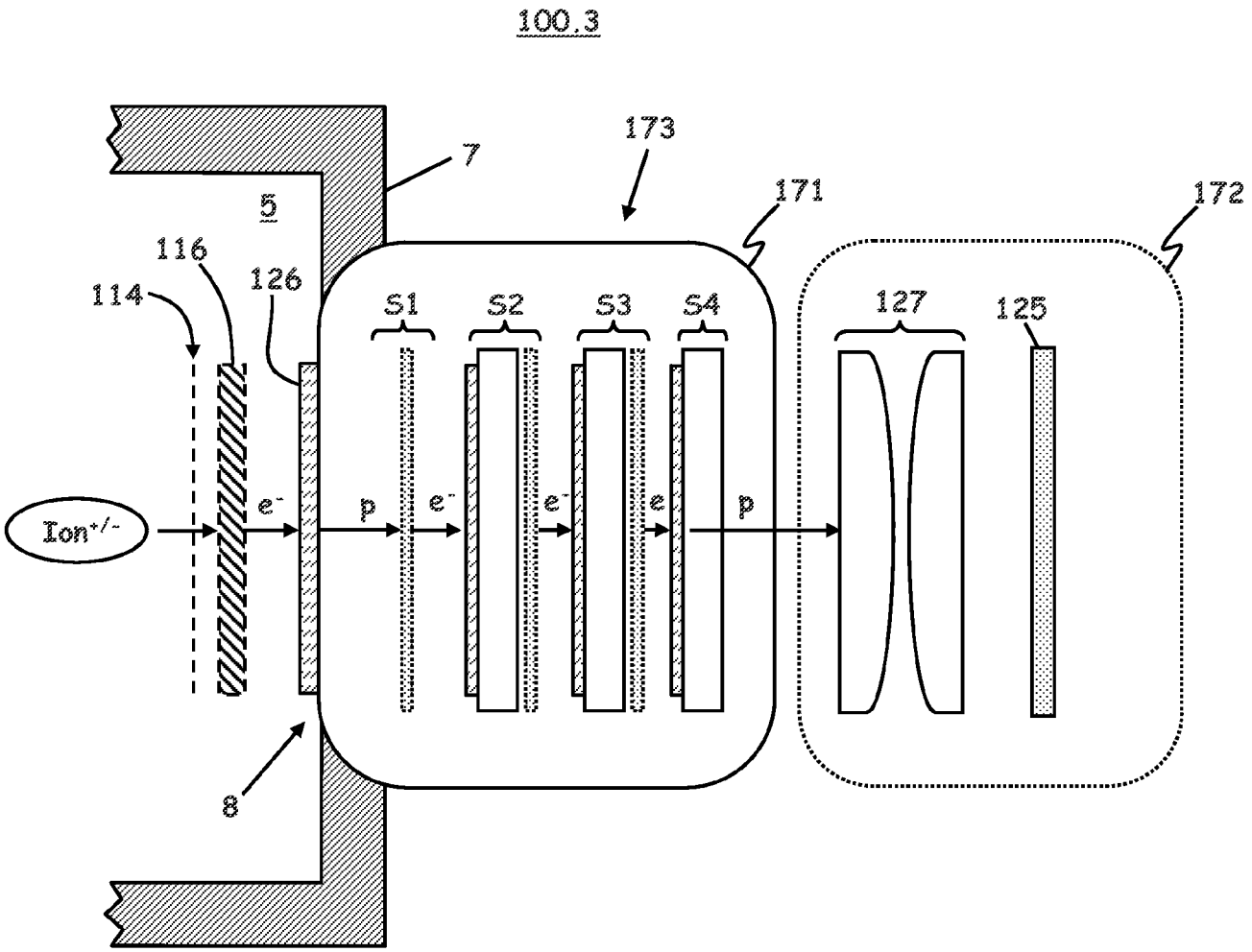
FIG. 2C is a schematic illustration of a third detector system, in accordance with the present teachings, for a mass spectrometer and having a cascaded-optical-gain section.

Alternatively, under circumstances in which the photocathode or phosphors of the detector system are not tolerant to air during shipment, it may be desirable to provide some of the detector components within a prefabricated, pre-evacuated and pre-sealed enclosure 171 as illustrated with regard to the detector system 100.3 shown in FIG. 2C. The enclosure 171 may comprise, for example, a glass tube. Alternatively, the enclosure 171 may be formed of some non-transparent material other than glass, provided that it includes a window of glass or other transparent material facing and providing an optical line of sight to the first gain stage S1 within the enclosure (see FIG. 2C).

Using the detector configuration illustrated in FIG. 2C, there may be no conventional detector within the high vacuum chamber 5. Instead, a housing or vacuum chamber wall 7 of the mass spectrometer is provided with an aperture 8 with which the enclosure may be mated so as to provide a vacuum seal between the enclosure 171 and the mass spectrometer housing or chamber wall 7. The MCD 116 and optional grid electrode 114 of the detector apparatus are not housed within the enclosure 171 but are, instead, disposed within the high vacuum chamber 5.

The gain stages S1-S4 housed within the enclosure 171 are generally as previously described except that the first gain stage S1 does not comprise a phosphor and may substantially consist of just a photocathode which may or may not be disposed upon a substrate plate. Instead, a phosphor coating 126 is applied to the outer surface of the glass enclosure or, alternatively, to the transparent window, if present, at a position such that, when the enclosure 171 is mated to the mass spectrometer housing or wall 7, the phosphor coating 126 is disposed along a line of sight between the MCD 116 and the first gain stage S1. Thus, in operation of the detector system 100.3, the phosphor coating 126 is disposed within the high vacuum chamber 5. Photons generated at the phosphor coating 126 pass through the transparent window (if present) or wall of the enclosure 171 so as to create secondary electrons at the photocathode of the first gain stage S1 within the enclosure 171. The enclosure 171 and the components therein may be regarded, when considered together, as an image intensifier 173 which receives a photonic signal from an external photon source—in this instance, phosphor 126—and emits, as output, an amplified version (indicated by the rightmost arrow labeled p) of the original signal.

The final, amplified batch of photons generated at the final gain stage (for example, gain stage S4) within the enclosure are focused by lens assembly 127 onto optical detector 125 as previously described. In some embodiments, the lens assembly 127 and optical detector 125 may be housed within the enclosure 171. In other alternative embodiments, either the optical detector 125 or the lens assembly 127 or both may be housed in an optional, separate enclosure 172. If the lens assembly 127 is not housed within the same enclosure 171 as the gain stages, then the enclosure may comprise a second window disposed such that there is a direct optical line of sight between the final gain stage and the lens assembly 127. As will be readily appreciated, the interior of the enclosure 171 will generally include not-illustrated additional elements, such as electrical leads and support structures and the enclosure 171 will generally include a vacuum feed-through component so as to route electrical wires into the enclosure.

Figure 2D:
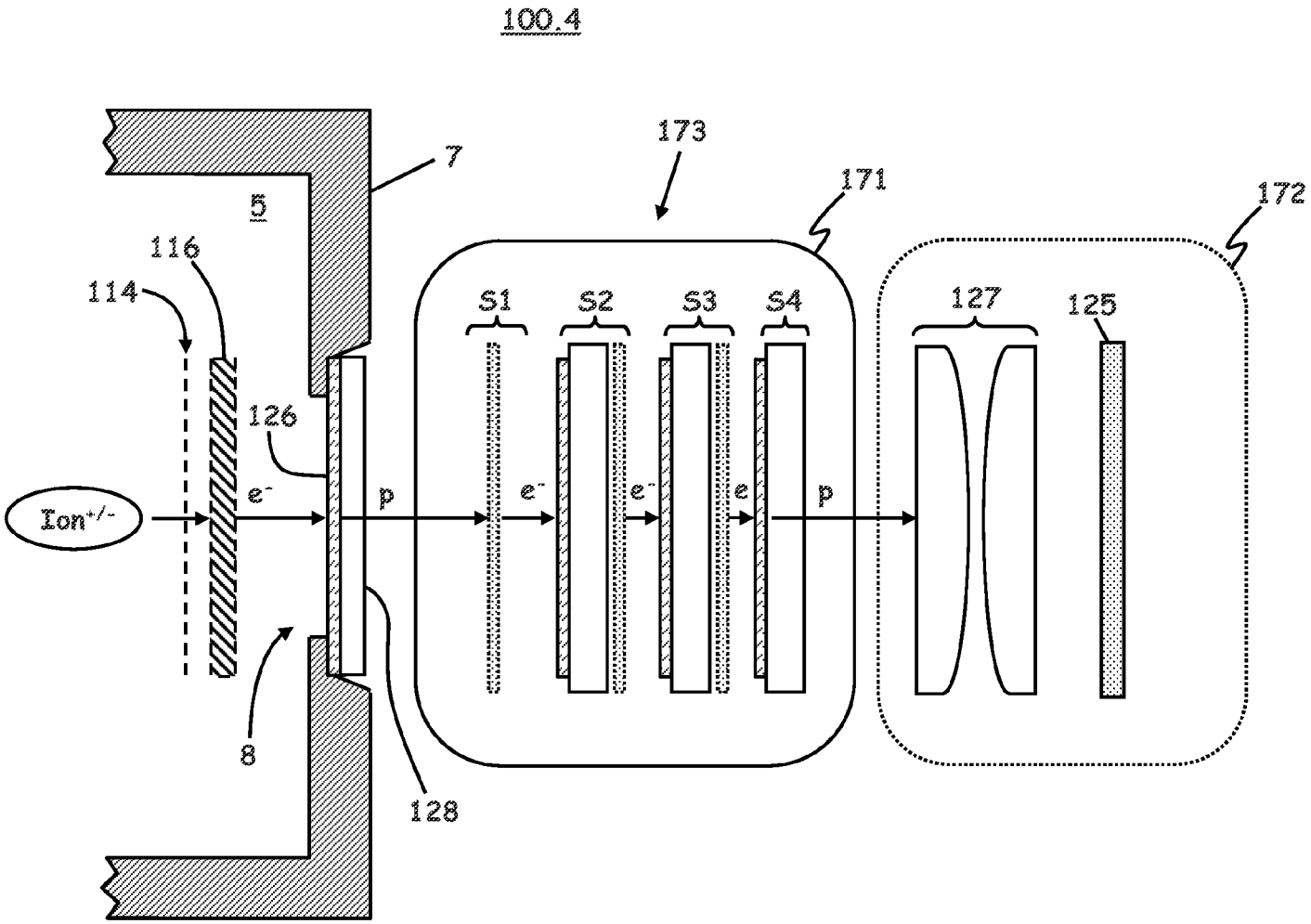
FIG. 2D is a schematic illustration of a fourth detector system, in accordance with the present teachings, for a mass spectrometer and having a cascaded-optical-gain section.

FIG. 2D illustrates a modified version of the detector system of FIG. 2C. In the detector system 100.4 shown in FIG. 2D, the image intensifier 173 does not form a vacuum seal against the vacuum chamber wall 7 of the mass spectrometer and may be physically separated from the wall. Further, the phosphor coating 126 within the high vacuum chamber 5 is not disposed on the enclosure 171 of the image intensifier 173. Instead, this phosphor coating is disposed as a coating on an optically transparent window 128 which forms a vacuum seal against the wall 7 within the aperture 8. Photons generated by the phosphor 126 pass out of the high vacuum chamber through the transparent window 128 and then pass into the interior of the image intensifier 173 through either an optically transparent enclosure 171 or, alternatively, a transparent window (not specifically shown) of an otherwise non-transparent enclosure. Although FIGS. 2C-2D illustrate an example of a specifically constructed image intensifier, it will be readily appreciated by one of ordinary skill in the art that any image intensifier may be employed in place of the illustrated image intensifier 173 provided that it provides suitable photon signal gain between the amplified photon signal required by the detector 125 and the photon signal generated within the mass spectrometer and further provided that appropriate image resolution is maintained at the detector 125.

In the preceding discussion of various detector system embodiments, the high gain characteristics of the cascaded gain stages are exploited, and the MCD 116 is essentially only needed to "convert" ions into electrons with minimal gain. Gain is provided by the cascade sections that have ample supply currents. The various detector system embodiments described above thus do not suffer from strip-current-limited dynamic range associated with present commercially available off-the-shelf high-gain micro-channel plates (MCPs). Although the above discussion considers the use of a metal channel dynode (MCD) as a low-gain alternative to an MCP, it should be noted that low gain MCP devices are nonetheless available. Such low-gain MCP devices could be employed as an alternative form of low-gain ion-to-electron converter in the presently-described detector systems. However, the inventors consider that such low gain MCP devices, although functional, are less preferable than MCD devices for use in the present application for the following reason. MCP gain is controlled by a combination of factors including the length-to-diameter ratio. Values of this ratio of 40:1 and 60:1 are typical, so the present application would require an MCP device in which the length-to-diameter ratio is 40:1. A device having such a length-to-diameter ratio is expected to be thinner and therefore more fragile.

Figure 3:
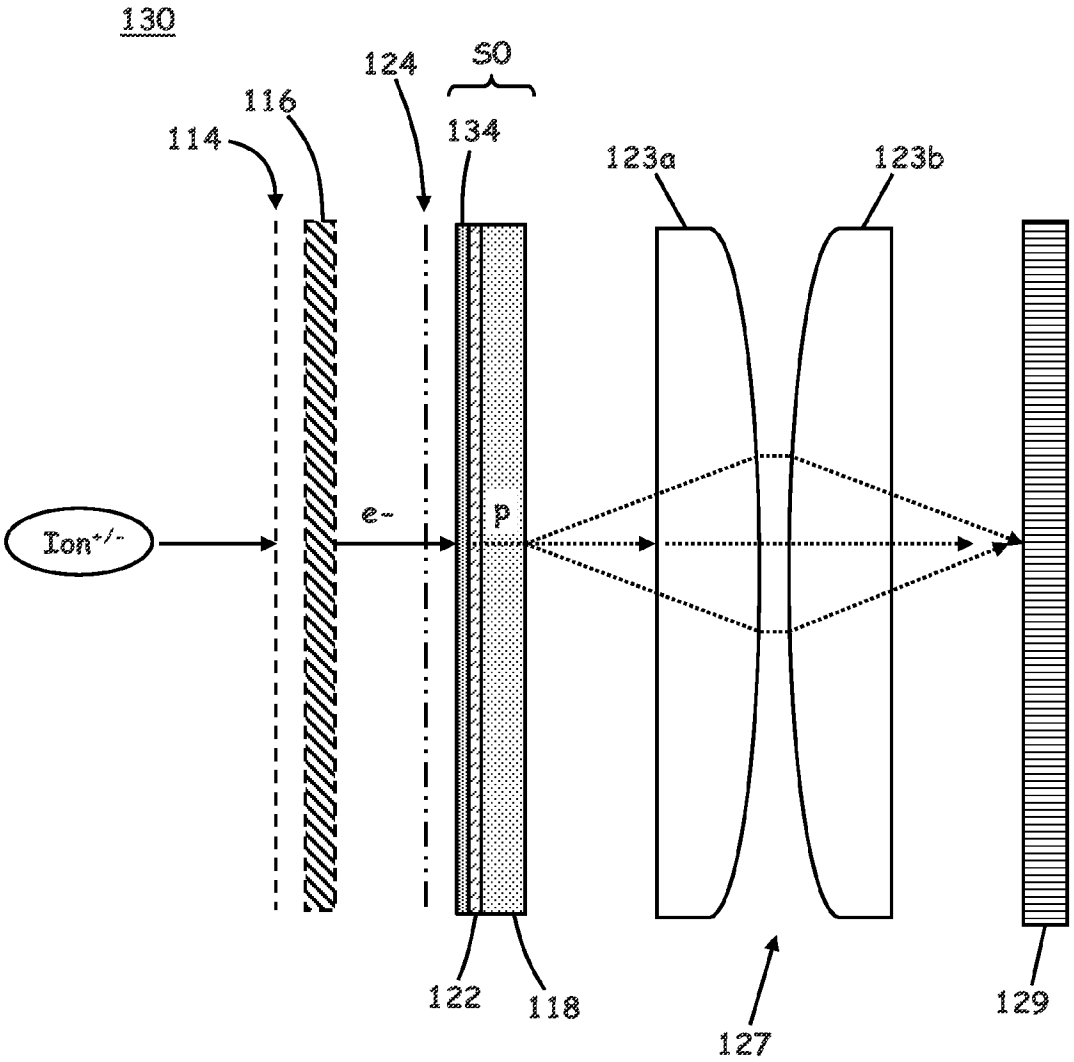
FIG. 3 is a schematic illustration of detector system, in accordance with the present teachings, comprising a low-gain ion-to-electron conversion element, an electron-to-photon conversion element, and a high-gain two-dimensional array of silicon photomultipliers.

FIG. 3 schematically illustrates another detector system, in accordance with the present teachings in which the CCD, CMOS, CID or other camera, as described above, is replaced a high-performance alternative system 129 comprising a two-dimensional array of silicon photomultipliers. Each such micro sensor is a high gain (e.g., $10^6$ gain) avalanche detector with a relatively rapid response and recovery. Such light detector systems are available in arrays of low-voltage avalanche photodiodes in pitch sizes of 10 μm, 20 μm, 30 μm and larger. Such an imaging system is expected to provide superior performance. Because of the high-gain characteristics of the camera 129, high-gain characteristics are not required of either the ion to electron converter (preferably an MCD but, alternatively, an MCP) or the photon generating assembly. Instead, a relatively low-gain photonic signal may be input to the silicon photomultiplier array 129 that is then employed to detect the photons and provide an amplified electronic signal. This amplified electronic signal may be provided at a level that is easily measured with a low-cost transimpedance amplifier and analog-to-digital converter (ADC). The relatively low-gain photonic signal may be provided by a single gain stage S0 comprising a substrate plate 118, phosphor 122 and electrode 134 but no photocathode as shown in FIG. 3. As previously described, the grid electrodes 114, 124 are optional components, either one or both of which may be included.

Figure 5A:
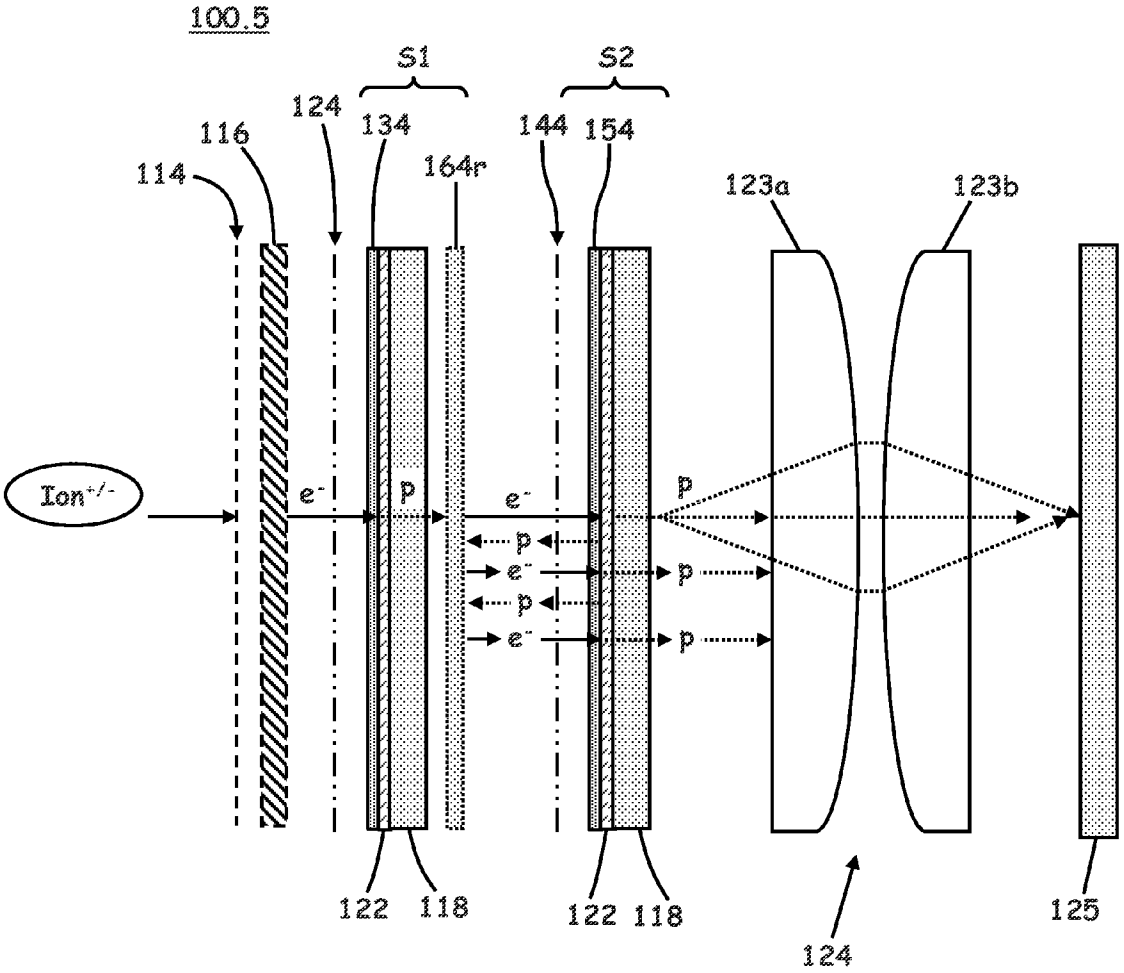
FIG. 5A is a schematic illustration of another detector system, in accordance with the present teachings, for a mass spectrometer and having a cascaded-optical-gain section.
Figure 5B:
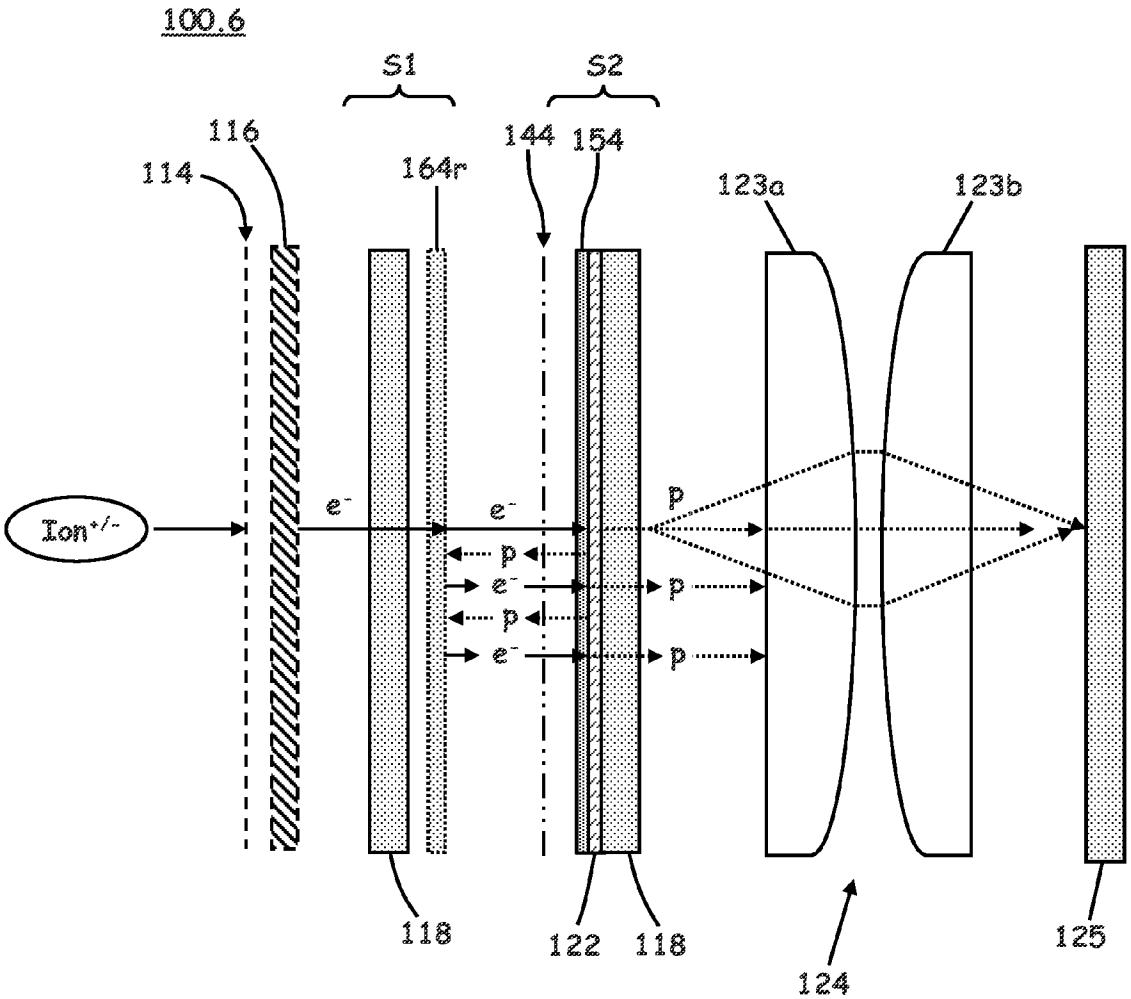
FIG. 5B is a schematic illustration of still another detector system, in accordance with the present teachings, for a mass spectrometer and having a cascaded-optical-gain section.

Other embodiments of detector systems in accordance with the present teachings may employ a semi-reflective metal layer disposed between each phosphor and the electron source from which it receives electrons, as schematically illustrated in FIGS. 5A-5B. It will be generally true that some proportion of photons emitted from each phosphor will propagate "backwards" towards the photocathode of the preceding gain stage, since photon emission is non-directional. The semi-reflective metal layer has the property of re-directing a portion of these back-emitted photons to the desired direction. The semi-reflective metal layer has the further property of allowing another controlled portion of the back-emitted photons to impinge upon the photocathode of the preceding gain stage so as to generate additional secondary electrons. This process forms a feedback loop as illustrated in alternately forward pointing and backward pointing arrows between gain stages S1 and S2 in the detector systems 100.5 and 100.6 of FIG. 5A and FIG. 5B, respectively. In these diagrams, the reflectively coated photocathode **164*r* carries the semi-reflective coating, although the coating could alternatively be disposed on a separate substrate element between the gain stages S1 and S2. By adjusting the reflectivity of the metal layer and the gain of the second phosphor stage, the system's response time and gain can be adjusted. If a photocathode is used that has the property of being transparent to electrons provided from the MCD (or MCP), then the first phosphor layer on gain stage S1 can be completely eliminated, as shown in FIG. 5**B.

In the controlled feedback arrangement illustrated in FIG. 5A, the system can become unusable as an image intensifier if the number of photons going in the "backwards" direction to the photocathode **164*r*** from the second phosphor is greater than the original number of incident photons. This situation will cause an avalanche scenario which saturates the detector output. Accordingly, the mode of operation must be tuned such that the gain of the second phosphor generates fewer photons going in the reverse direction than the previous amplification cycle generated in the forward direction. This can be achieved by adjusting the bias voltage to change the electron energy for electrons impacting the second phosphor. Lowering the electron energy lowers the phosphor gain. If the reflectivity is 90% and the photocathode has a quantum efficiency of 20%, then 1 photon out of every 100 will generate a feedback event assuming the photons are generated in random directions. To avoid an avalanche scenario, the phosphor must be tuned to generate less than 100 photons per incident electron in this case. With a phosphor gain of 50 photons per electron, the net system gain is approximately 95 and reaches 90% gain within 4 cycles. At a phosphor gain of 75, the net gain rises to 285 and reaches 90% of the total gain by 9 cycles.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the invention. Additionally, it will be understood that any list of candidates or alternatives is merely illustrative, not limiting, unless implicitly or explicitly understood or stated otherwise. In addition, unless otherwise indicated, numbers expressing various measured or measurement quantities such as length, size, percentage, gain factor, etc. as used in the specification and claims are to be understood as being modified by the term "about."

The discussion included in this application is intended to serve as a basic description. The present invention is not to be limited in scope by the specific embodiments described herein, which are intended as single illustrations of individual aspects of the invention, and functionally equivalent methods and components are within the scope of the invention. Indeed, various modifications of the invention, in addition to those shown and described herein will become apparent to those skilled in the art from the foregoing description and accompanying drawings. Such modifications are intended to fall within the scope of the appended claims. Any patents, patent applications, patent application publications or other literature mentioned herein are hereby incorporated by reference herein in their respective entirety as if fully set forth herein, except that, in the event of any conflict between the incorporated reference and the present specification, the language of the present specification will control.

What is claimed is:

1. A detector system for a mass spectrometer for detecting time-dependent two-dimensional distributions of ions that exit a mass analyzer of the mass spectrometer, the detector system comprising:

(a) a metal channel dynode (MCD) disposed within a high vacuum chamber of the mass spectrometer, said vacuum chamber comprising a wall having an aperture therethrough, said MCD comprising at least one perforated metal plate and configured to receive the exiting ions and eject electrons in response thereto;

(b) at least one direct current (DC) power supply electrically coupled to the MCD;

(c) an optically transparent plate or wall disposed against the vacuum chamber wall aperture and forming a vacuum seal therewith;

(d) a phosphor coating disposed on the optically transparent plate or wall and within the vacuum chamber so as to receive the ejected electrons;

(e) an image intensifier optically coupled to the optically transparent plate or wall so as to receive a quantity of photons generated at the phosphor coating and to emit an amplified quantity of photons proportionate to the quantity of photons, wherein the image intensifier includes an evacuated housing and the optically transparent plate or wall comprises a portion of the housing; and (f) an optical detector optically coupled the image intensifier and configured so as to receive the amplified quantity of photons.

2. A detector system as recited in claim 1, further comprising:

(g) a lens assembly providing the optical coupling between the image intensifier and the optical detector.

3. A detector system as recited in claim 1, wherein the MCD comprises a shadow mask.

4. A detector system as recited in claim 1, wherein the MCD is coated with a metal oxide enhancer.

5. A detector system as recited in claim 1, wherein the MCD comprises a perforated metal plate having parallel first and second faces and in which the perforations comprise slots through the plate that slope at an angle to the parallel plate faces.

6. A detector system as recited in claim 1, wherein the MCD comprises a plurality of perforated metal plates arranged in a stacked arrangement such that the perforations of each succeeding plate are laterally offset from the perforations of the respective preceding plate.

7. A detector system as recited in claim 1, wherein the optical detector comprises either a charge coupled device (CCD) or a charge injection device (CID) camera.

8. A detector system for a mass spectrometer for detecting time-dependent two-dimensional distributions of ions that exit a mass analyzer of the mass spectrometer, the detector system comprising:

(a) a metal channel dynode (MCD) disposed within a high vacuum chamber of the mass spectrometer, said vacuum chamber comprising a wall having an aperture therethrough, said MCD comprising at least one perforated metal plate and configured to receive the exiting ions and eject electrons in response thereto;

(b) at least one direct current (DC) power supply electrically coupled to the MCD;

(c) an optically transparent plate or wall disposed against the vacuum chamber wall aperture and forming a vacuum seal therewith;

(d) a phosphor coating disposed on the transparent plate or wall and within the vacuum chamber so as to receive the ejected electrons;

(e) an image intensifier optically coupled to the transparent plate or wall so as to receive a quantity of photons generated at the phosphor coating and to emit an amplified quantity of photons proportionate to the quantity of photons: wherein the image intensifier comprises:

(e1) at least one photocathode electrically coupled to the at least one DC power supply, one photocathode of the at least one photocathode optically coupled to the optically transparent plate or wall so as to receive the quantity of photons generated at the phosphor coating and to emit a proportionate quantity electrons in response thereto; and (e2) at least one electron-to-photon converter comprising:

(e2a) a substrate plate comprising first and second parallel faces;

(e2b) a phosphor coating on the first face of the substrate plate; and (e2c) an electrode film disposed on the phosphor coating on the first face and electrically coupled to the at least one DC power supply, wherein at least one phosphor coating on at least one first face is configured to receive the quantity of electrons or a different quantity of electrons generated within the image intensifier and to emit the amplified quantity of photons in response thereto; and (f) an optical detector optically coupled the image intensifier and configured so as to receive the amplified quantity of photons.

9. A detector system as recited in claim 8, wherein at least one substrate plate comprises a fiber-optic plate comprising a bundle of optical fibers.

10. A detector system as recited in claim 8, wherein at least one substrate plate comprises a mica plate.

11. A detector system as recited in claim 8, further comprising:

(g) a lens assembly providing the optical coupling between the image intensifier and the optical detector.

12. A detector system as recited in claim 8, wherein the MCD comprises a shadow mask.

13. A detector system as recited in claim 8, wherein the MCD is coated with a metal oxide enhancer.

14. A detector system as recited in claim 8, wherein the MCD comprises a perforated metal plate having parallel first and second faces and in which the perforations comprise slots through the plate that slope at an angle to the parallel plate faces.

15. A detector system as recited in claim 8, wherein the MCD comprises a plurality of perforated metal plates arranged in a stacked arrangement such that the perforations of each succeeding plate are laterally offset from the perforations of the respective preceding plate.

16. A detector system as recited in claim 8, wherein the optical detector comprises either a charge coupled device (CCD) or a charge injection device (CID) camera.

* * * * *